US010787723B2

(12) United States Patent
Lukezic

(10) Patent No.: US 10,787,723 B2
(45) Date of Patent: Sep. 29, 2020

(54) NICKEL BASE CASTING ALLOY, CASTING, AND METHOD FOR MANUFACTURING AN IMPELLER OF A ROTARY MACHINE

(71) Applicant: Sulzer Management AG, Winterthur (CH)

(72) Inventor: David Lukezic, Rikon im Tösstal (CH)

(73) Assignee: SULZER MANAGEMENT AG, Winterthur (CH)

( * ) Notice: Subject to any disclaimer, the term of this patent is extended or adjusted under 35 U.S.C. 154(b) by 274 days.

(21) Appl. No.: 15/805,822

(22) Filed: Nov. 7, 2017

(65) Prior Publication Data

US 2018/0148814 A1 May 31, 2018

(30) Foreign Application Priority Data

Nov. 29, 2016 (EP) ..... 16201193

(51) Int. Cl.

| | |
|---|---|
| ***C22C 19/05*** | (2006.01) |
| ***B22D 18/00*** | (2006.01) |
| ***F01D 5/02*** | (2006.01) |
| ***F01D 25/00*** | (2006.01) |

(52) U.S. Cl.

CPC ..... *C22C 19/055* (2013.01); *B22D 18/00* (2013.01); *C22C 19/05* (2013.01); *C22C 19/056* (2013.01); *F01D 5/02* (2013.01); *F01D 25/005* (2013.01); *F05D 2230/21* (2013.01); *F05D 2300/17* (2013.01)

(58) Field of Classification Search

CPC ..... C22C 19/055; C22C 19/056

See application file for complete search history.

(56) References Cited

U.S. PATENT DOCUMENTS

| | | | |
|---|---|---|---|
| 5,556,594 | A | 9/1996 | Frank et al. |
| 6,315,846 | B1 | 11/2001 | Hibner et al. |
| 2014/0154093 | A1 | 6/2014 | Hawk et al. |

FOREIGN PATENT DOCUMENTS

| | | | |
|---|---|---|---|
| EP | 1334215 | B1 | 12/2006 |
| EP | 1903121 | A1 | 3/2008 |
| EP | 2283952 | A2 | 2/2011 |

OTHER PUBLICATIONS

Extended European Search Report dated May 8, 2017 in corresponding European Patent Application No. 16201193.6, filed Nov. 29, 2016.

*Primary Examiner* — Jessee R Roe

(74) *Attorney, Agent, or Firm* — Global IP Counselors, LLP

(57) ABSTRACT

A nickel base casting alloy includes a composition, by weight percent: 19.0-22.5 chromium, 7.0-9.5 molybdenum, 2.75-4.0 niobium, 1.0-1.7 titanium, 0.35-1.0 manganese, 0.2-1.0 silicon, 0-0.03 carbon, 0-0.015 phosphorus, 0-0.01 sulfur, 0-0.35 aluminum, 0-13.25 iron, the balance being nickel and incidental impurities.

17 Claims, No Drawings

NICKEL BASE CASTING ALLOY, CASTING, AND METHOD FOR MANUFACTURING AN IMPELLER OF A ROTARY MACHINE

CROSS-REFERENCE TO RELATED APPLICATION

This application claims priority to European Application No. 16201193.6, filed Nov. 29, 2016, the contents of which are hereby incorporated herein by reference.

BACKGROUND

Field of the Invention

The invention relates to a nickel base casting alloy suitable for manufacturing castings and to a casting made from such an alloy. Furthermore, the invention relates to a method for manufacturing an impeller of a rotary machine by such an alloy.

Background of the Invention

For manufacturing an impeller of a rotary machine such as a single stage or a multistage centrifugal pump, a turbine, a compressor, an expander or the like, it is known to use a casting or investment casting process. In such a process a metallic material, for example an alloy, of a desired composition is provided as a melt. The melt is poured in a mold, e.g. a sand mold, a metallic mold or a combination thereof, and the melt in the mold is allowed to solidify. After solidification of the material in the mold the casting is removed from the mold. In many cases the casting is subsequently subjected to a densification or consolidation process in order to reduce the porosity of the casting and to remove undesired internal cavities or holes. The densification may be achieved by applying an isostatic pressure to the casting. Usually the densification takes place at elevated temperatures of some hundreds and sometimes even more than 1000 degree Celsius. A known process for the densification of metallic casting is hot isostatic pressing (HIP). After the densification step a finishing procedure may be applied comprising for example milling or machining or grinding or polishing.

The choice of an appropriate metallic material for manufacturing the impeller depends on the application for which the impeller is used. For example, in the oil and gas industry it is often a requirement that the rotary machine has to be able to handle sour fluids. Such environments may comprise high concentrations of hydrogen sulfide, carbon dioxide and chlorides creating very aggressive conditions for the impeller. Therefore, corrosion resistance is a very important aspect when choosing an appropriate material for manufacturing impellers.

In particular, the impeller should have a high resistance against localized corrosion such as pitting corrosion or crevice corrosion. The resistance of a material against localized corrosion is quite often characterized by the pitting resistance equivalent number (PREN). The higher the PREN value the more corrosion resistant the metallic material. A well-known material with a high corrosion resistance, which is often used for casting impellers, is duplex steel or super duplex steel. These are stainless steels having a mixed microstructure of austenite and ferrite. Typically, super duplex has a PREN value of at least 40 indicating its high resistance against corrosion.

Another very important aspect when choosing an impeller material are the mechanical properties of the material, such as the tensile strength, the yield strength or the fatigue strength. Usually these properties are measured by parameters like the 0.2% proof stress or the ultimate tensile strength.

Duplex and super duplex steel have proven to be very good materials for casting impellers, for example pump impellers. However today's and future applications require even stronger pumps, i.e. high energy pumps, producing such enormous heads and/or flows that the resulting loads exceed the maximum stress or strength that an impeller made of super duplex may withstand. For example there is a desire to manufacture pumps that can create a head of at least 800 meter per stage or even more. The mechanical properties of duplex or super duplex steels may not be sufficient to handle the resulting huge loads over an economically reasonable lifetime.

There are other materials known in the art having mechanical properties exceeding those of super duplex, for example hyper duplex, titanium alloys and such superalloys that are available under the tradename Rene 41 or Inconel 725. However, these alloys are either based on titanium, contain significant amounts of cobalt, or cannot be processed by casting or it is at least extremely laborious and expensive to process these materials by means of casting or investment casting. Today, these nickel or iron based alloys are usually processed by hot working or a powder metallurgy process, for example by hot isostatic pressing of a powder.

SUMMARY

Starting from this state of the art it is therefore an object of the invention to propose a new casting alloy suitable for manufacturing castings by a conventional casting or investment casting process. The alloy shall have mechanical properties, in particular strength, exceeding the mechanical properties of super duplex steel. Concurrently, the corrosion resistance of the alloy shall be at least approximately the same as the one of super duplex steel. Furthermore, it is an object of the invention to propose a casting made of such an alloy. In addition, it is an object of the invention to propose a method for manufacturing an impeller of a rotary machine.

The subject matter of the invention satisfying these objects is characterized by the features described herein.

DETAILED DESCRIPTION

Thus, according to the invention a nickel base casting alloy is proposed consisting of the composition, by weight percent: 19.0-22.5 chromium, 7.0-9.5 molybdenum, 2.75-4.0 niobium, 1.0-1.7 titanium, 0.35-1.0 manganese, 0.2-1.0 silicon, 0-0.03 carbon, 0-0.015 phosphorus, 0-0.01 sulfur, 0-0.35 aluminum, 0-13.25 iron, the balance being nickel and incidental impurities.

Surprisingly, it has been found that such a nickel base alloy is suitable for a conventional casting or investment casting process, in which a melt of the alloy is introduced into a mold for solidification. In addition, the alloy according to the invention has mechanical properties, in particular with respect to its strength, that clearly exceed the mechanical properties of super duplex, at least at an ambient temperature, for example at 20° C. The corrosion resistance of the alloy according to the invention is at least approximately the same as the corrosion resistance of super duplex steel.

Preferably, the alloy comprises 57-61 weight percent nickel.

According to a preferred embodiment, the alloy comprises at least 0.25 weight percent silicon, preferably at least 0.50 weight percent silicon.

According to a preferred embodiment, the alloy comprises at least 0.40 weight percent manganese, preferably at least 0.60 weight percent manganese.

It is preferred when the alloy comprises at least 0.25 weight percent silicon and at least 0.40 weight percent manganese.

In a preferred embodiment the alloy comprises at most 10 weight percent iron, preferably at most 8 weight percent iron.

Preferably, the alloy comprises 4-6 weight percent iron.

In a preferred embodiment, the alloy has a 0.2% proof stress of at least 750 MPa, preferably at least 850 MPa, at 20° Celsius.

In addition, according to the invention a casting is proposed that is cast from an alloy according to the invention.

According to a preferred embodiment, the casting is an impeller of a rotary machine.

In addition, according to the invention a method is proposed for manufacturing an impeller of a rotary machine comprising the steps of:

providing a melt of an alloy in accordance with the invention, introducing the melt into a mold for producing a casting, removing the casting from the mold after solidification of the melt, finishing the casting to produce the impeller.

Preferably, the solidified casting is densified by applying an isostatic pressure of at least 10 MPa.

Preferably, the casting is densified by hot isostatic pressing at a temperature of at least 700° C.

Furthermore, according to the invention an impeller of a rotary machine, in particular of a pump, is proposed manufactured with a method according to the invention.

Further advantageous measures and embodiments of the invention will become apparent from the dependent claims.

The invention will now be explained in more detail.

According to the invention a casting alloy is proposed that is a nickel base alloy. The term "casting alloy" shall mean that the alloy is suitable for manufacturing castings in a usual casting procedure where a melt of the alloy is introduced in a mold and allowed to solidify in the mold. After solidification the casting is removed from the mold. I.e. a casting alloy shall have the property that it can be processed in a usual casting or investment casting method.

It goes without saying that the casting alloy may also be used for other manufacturing methods than casting. For example, the casting alloy may also be processed by a powder metallurgy process, in which a powder blend of the nominal composition of the alloy is subjected to pressure, in particular isostatic pressure, to form a work piece. In particular the casting alloy according to the invention may also be used for manufacturing a work piece from a powder blend by means of hot isostatic pressing (HIP).

The nickel base casting alloy according to the invention consists of the following composition, by weight percent: 19.0-22.5 chromium (Cr), 7.0-9.5 molybdenum (Mo), 2.75-4.0 niobium (Nb), 1.0-1.7 titanium (Ti), 0.35-1.0 manganese (Mn), 0.2-1.0 silicon (Si), 0-0.03 carbon (C), 0-0.015 phosphorus (P), 0-0.01 sulfur (S), 0-0.35 aluminum (Al), 0-13.25 iron (Fe), the balance being nickel (Ni) and incidental impurities.

The resulting alloy is in particular characterized by a very high corrosion resistance, particularly against localized corrosion such as pitting corrosion or crevice corrosion, in combination with very good mechanical properties.

The corrosion resistance of the nickel base alloy according to the invention is at least approximately the same as the corrosion resistance of super duplex steel, whereas the mechanical properties of the nickel base alloy exceed the mechanical properties of super duplex. In particular, the mechanical strength of the alloy according to the invention is remarkably higher than the mechanical strength of super duplex.

Super duplex steel designates the steel with the UNS 532750 and the UNS 532760. UNS (unified numbering system for metals and alloys) is a widely accepted designation system for alloys.

It is usual to measure the localized corrosion resistance of a metallic material by its pitting resistance equivalent number (PREN). Super duplex steel has a PREN of at least 40. The PREN of the nickel base alloy according to the invention is also at least 40.

The mechanical properties of a metallic material are usually characterized by its yield strength and its tensile strength at an ambient temperature of 20 degree Celsius. As a measure for the yield strength of a metallic material it is common use to indicate the 0.2% proof stress of the material. The 0.2% proof stress is the mechanical stress at which the relative elongation of a sample of the material remaining after releasing the stress is 0.2% relative to the original length of the sample. Thus, the 0.2% proof stress is the mechanical stress at which a 0.2% plastic elongation occurs. The ultimate tensile strength is usually considered as the maximum in the stress-strain curve of a material. This ultimate tensile strength is sometimes also referred to as tensile strength.

The 0.2% proof stress for super duplex steel at 20° C. is typically around 550 MPa and its ultimate tensile strength around 750 MPa at 20° C.

The mechanical properties of the alloy according to the invention are better than those of super duplex steel. In particular, the mechanical strength of the alloy according to the invention is considerably higher than the strength of super duplex steel. Typically an alloy with the composition according to the invention has a 0.2% proof stress of at least 750 MPa at 20° C. The 0.2% proof stress may even exceed 850 MPa. The tensile strength of the alloy according to the invention is at least 1000 MPa at 20° C.

Due to the higher yield and tensile strength the alloy according to the invention also has a higher fatigue strength than super duplex steel.

The preferred range for the nickel content of the alloy according to the invention is 57 to 61 weight percent.

The preferred range for the silicon content is at least 0.25 and at most 1.0 weight percent. It is particularly preferred that the silicon content is at least 0.5 weight percent.

Regarding the manganese content the preferred range is at least 0.40 and at most 1.0 weight percent. Particularly preferred the manganese content is at least 0.6 weight percent.

In addition, it is preferred when the silicon content is at least 0.25 weight percent and concurrently the manganese content is at least 0.40 weight percent.

According to an exemplary embodiment of the invention the nickel base casting alloy consists of the following nominal composition by weight percent:

Example

C: 0.01%; Mn: 0.8%; P: 0.008%; S: 0.005%; Si: 0.7%; Cr: 21%; Mo: 8.5%; Nb: 3.3%; Ti: 1.3%; Al: 0.2%; Fe: 5.2%;

Ni: balance. This results in a Ni content of approximately 59 weight percent. The PREN of this specific example is approximately 49.1.

The nickel base casting alloy according to the invention is particularly suited for the casting or the investment casting of impellers of a rotary machine, for example pump impellers.

According to an embodiment of the method for manufacturing an impeller, a melt is provided for the casting process, the melt having the nominal composition of a nickel base casting alloy according to the invention. E.g. the melt has the composition as given in the Example above. The melt may be produced in any known manner. For example, a feedstock is prepared from different components that might be powders, or grains, or pellets or other pieces of material, or combinations thereof. Each component may contain one or more of the elements used for the alloy. For example, ferroalloys may be used for preparing the feedstock. The feedstock is proportioned to attain the nominal composition of the alloy to be produced.

The feedstock is molten and stirred to produce a homogeneous melt. The melt is poured in a casting mold which is designed for creating the desired shape of the impeller. Of course, the mold may comprise a plurality of compartments each of which is designed for forming an impeller such that a plurality of impellers may be produced in a single casting step. After the melt has solidified the casting or the castings is/are removed from the mold.

Preferably the casting(s) is/are subjected to a densification or consolidation process after being removed from the mold. The densification for reducing the porosity of the casting(s) or for reducing internal and undesired cavities in the structure of the casting(s) is preferably performed by applying an isostatic pressure of at least 10 MPa to the casting(s). Most preferred the densification is performed at an elevated temperature of at least 700° C., preferably of at least 750° C. The densification may be achieved by hot isostatic pressing (HIP) of the casting(s). The HIP process for densifying castings as such is known in the art and therefore not explained in more detail. Typically, in such a HIP process an isostatic pressure in the range of 10 to 200 MPa is applied.

After the densification the impeller may be finished by machining, grinding polishing or other known finishing methods.

The invention claimed is:

1. A casting cast from a nickel base casting alloy consisting of:

a composition, by weight percent: 19.0-22.5 chromium, 7.0-9.5 molybdenum, 2.75-4.0 niobium, 1.0-1.7 titanium, 0.35-1.0 manganese, 0.2-1.0 silicon, 0-0.03 carbon, 0-0.015 phosphorus, 0-0.01 sulfur, 0-0.35 aluminum, 0-13.25 iron, the balance being nickel and incidental impurities, the casting being an impeller of a rotary machine.

2. The casting in accordance with claim 1, wherein the composition includes 57-61 weight percent nickel.

3. The casting in accordance with claim 1, wherein the composition includes at most 10 weight percent iron.

4. The casting in accordance with claim 1, wherein the composition includes 4-6 weight percent iron.

5. The casting in accordance with claim 1, wherein the composition includes a 0.2% proof stress of at least 750 MPa, at 20° Celsius.

6. The casting in accordance with claim 1, wherein the composition includes at least 0.50 weight percent silicon.

7. The casting in accordance with claim 1, wherein the composition includes at least 0.60 weight percent manganese.

8. The casting in accordance with claim 1, wherein the composition includes at most 8 weight percent iron.

9. The casting in accordance with claim 1, wherein the composition includes a 0.2% proof stress of at least 850 MPa, at 20° Celsius.

10. The casting in accordance with claim 1, wherein the composition includes at least 0.25 weight percent silicon.

11. The casting in accordance with claim 1, wherein the composition includes at least 0.40 weight percent manganese.

12. The casting in accordance with claim 1, wherein the composition includes at least 0.25 weight percent silicon and at least 0.40 weight percent manganese.

13. A method for manufacturing the impeller of the rotary machine in accordance with claim 1, the method comprising:

providing a melt of the nickel base casting alloy, introducing the melt into a mold for producing the casting, removing the casting from the mold after solidification of the melt, and finishing the casting to produce the impeller.

14. The method in accordance with claim 13, wherein the solidified casting is densified by applying an isostatic pressure of at least 10 MPa.

15. The method in accordance with claim 14, wherein the casting is densified by hot isostatic pressing at a temperature of at least 700° C.

16. An impeller of a rotary machine manufactured with a method according to claim 13.

17. The impeller of a rotary machine in accordance with claim 16, wherein the rotary machine is a pump.

* * * * *